US012185762B2

(12) United States Patent
Zominy

(10) Patent No.: US 12,185,762 B2
(45) Date of Patent: Jan. 7, 2025

(54) MOUTHPIECE PORTION FOR AN ELECTRONIC CIGARETTE PREVENTING ANY UNDESIRED LOSS OF LIQUID

(71) Applicant: JT International SA, Geneva (CH)

(72) Inventor: Claude Zominy, Copponex (FR)

(73) Assignee: JT International S.A. (CH)

( * ) Notice: Subject to any disclaimer, the term of this patent is extended or adjusted under 35 U.S.C. 154(b) by 387 days.

(21) Appl. No.: 17/638,497

(22) PCT Filed: Aug. 28, 2020

(86) PCT No.: PCT/EP2020/074127
§ 371 (c)(1),
(2) Date: Feb. 25, 2022

(87) PCT Pub. No.: WO2021/038073
PCT Pub. Date: Mar. 4, 2021

(65) Prior Publication Data

US 2022/0400759 A1 Dec. 22, 2022

(30) Foreign Application Priority Data

Aug. 30, 2019 (EP) ..... 19194721

(51) Int. Cl.
*A24F 40/48* (2020.01)
*A24F 40/10* (2020.01)

(52) U.S. Cl.
CPC ..... *A24F 40/48* (2020.01); *A24F 40/10* (2020.01)

(58) Field of Classification Search
CPC ..... A24F 40/48; A24F 40/485; A24F 40/10; A24F 40/40
See application file for complete search history.

(56) References Cited

U.S. PATENT DOCUMENTS 10,004,274 B2 * 6/2018 Li ..... A61M 11/042
10,064,433 B2 * 9/2018 Li ..... H05B 3/0014
(Continued)

FOREIGN PATENT DOCUMENTS

CN 204599324 U 9/2015
EP 3216477 A2 9/2017
(Continued)

OTHER PUBLICATIONS

International Search Report for PCT/EP2020/074127 dated Nov. 13, 2020. 4 pgs.

*Primary Examiner* — Hae Moon Hyeon
(74) *Attorney, Agent, or Firm* — Lerner David LLP

(57) ABSTRACT

A mouthpiece portion of an electronic cigarette includes a cartridge comprising a liquid store having a housing configured to store a liquid to be vaporized, the cartridge comprising a main vapor channel extending therethrough, between an air inlet opening through a vaporization chamber and to a vapor outlet opening; a mouthpiece connectable to a main body of the electronic cigarette, the mouthpiece comprising a vapor channel for receiving vapor from the main vapor channel of the cartridge. The cartridge is axially displaceable by a consumer with respect to the mouthpiece in the axial direction A thereof and movable between a first position and a second position. In the first position both the air inlet opening and the vapor outlet opening of the cartridge are open, and in the second position both the air inlet opening and the vapor outlet opening of the cartridge are closed.

19 Claims, 4 Drawing Sheets

(56) References Cited

U.S. PATENT DOCUMENTS

Figure 1A:
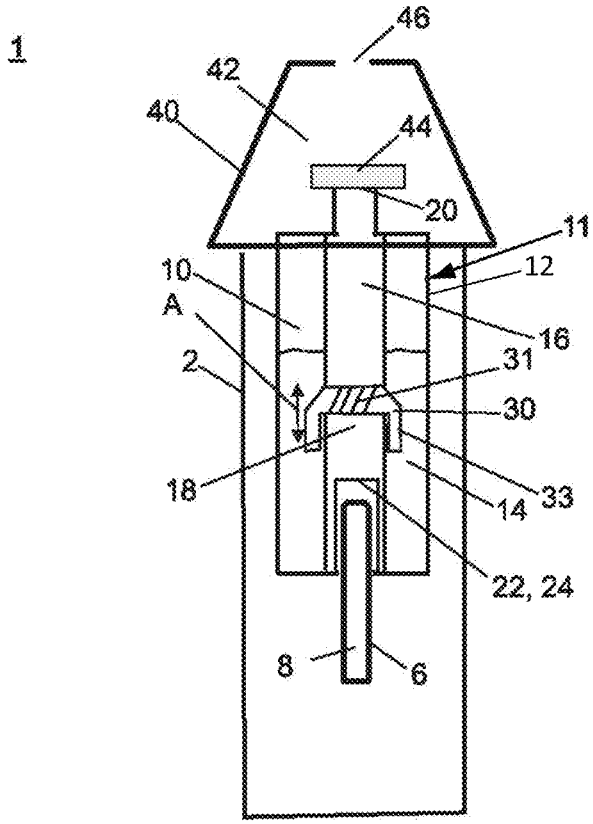

| | | | | |
|---|---|---|---|---|
| 11,077,262 | B2 * | 8/2021 | Li | A61M 15/0021 |
| 11,160,940 | B2 * | 11/2021 | Rogan | A61M 15/06 |
| 2018/0000156 | A1 * | 1/2018 | Qiu | A24F 40/40 |
| 2018/0310614 | A1 * | 11/2018 | Xu | A61M 15/06 |
| 2020/0146351 | A1 * | 5/2020 | Rogan | A24F 40/42 |

FOREIGN PATENT DOCUMENTS

| | | | |
|---|---|---|---|
| WO | 2017032695 | A1 | 3/2017 |
| WO | 2017093452 | A1 | 6/2017 |
| WO | 2017129616 | A1 | 8/2017 |
| WO | 2019081384 | A1 | 5/2019 |

* cited by examiner

MOUTHPIECE PORTION FOR AN ELECTRONIC CIGARETTE PREVENTING ANY UNDESIRED LOSS OF LIQUID

CROSS-REFERENCE TO RELATED APPLICATIONS

The present application is a national phase entry under 35 U.S.C. § 371 of International Application No. PCT/EP2020/074127, filed Aug. 28, 2020, which claims priority to European Application No. 19194721.7, filed Aug. 30, 2019, the disclosures of which are incorporated herein by reference.

FIELD OF THE INVENTION

The present invention relates to personal vaporizing devices, such as electronic cigarettes. In particular, the invention relates to a mouthpiece portion for an electronic cigarette.

BACKGROUND

Electronic cigarettes are an alternative to conventional cigarettes. Instead of generating a combustion smoke, they vaporize a liquid, which can be inhaled by a user. The liquid typically comprises an aerosol-forming substance, such as glycerin or propylene glycol that creates the vapor. Other common substances in the liquid are nicotine and various flavorings. The electronic cigarette is a hand-held inhaler system, comprising a mouthpiece section, a liquid store and a power supply unit. Vaporization is achieved by a vaporizer or heater unit which typically comprises a heating element in the form of a heating coil and a fluid transfer element. The vaporization occurs when as the heater heats up the liquid in the wick until the liquid is transformed into vapor.

The electronic cigarette may comprise a chamber, which is configured to receive disposable consumables in the form of capsules. Capsules comprising the liquid store and the vaporizer are often referred to as "cartomizers".

The prior art document EP 3 216 477 A2 describes a mouthpiece assembly by which the amount of aerosol output can be adjusted. The mouthpiece assembly includes a blocking element at the base thereof, which defines at least one through hole and which is capable of preventing air from flowing through. The mouthpiece, when pushed inside, is capable of driving the blocking element to rotate relative to the base so that an area of at least one opening formed by the at least one through hole and an air inlet can be changed. Thus, the aerosol passage through the mouthpiece can be adjusted.

When the inlet and outlet openings of the liquid capsules of the prior art are open to the ambient there is on the one hand the risk of leaking and on the other hand the liquid may evaporate or dry out over the time, even when not in use. Thus, the need exists to provide a solution for preventing any undesired loss of liquid, particularly by leaking of liquid from a liquid capsule and by drying out.

SUMMARY OF THE INVENTION

The above-mentioned problem is solved by a mouthpiece portion for an electronic cigarette according to claim 1.

In a first aspect of the invention the mouthpiece portion for an electronic cigarette, the mouthpiece portion comprising a cartridge comprising a liquid store having a housing configured to store a liquid to be vaporized, the cartridge comprising a main vapor channel extending therethrough, between an air inlet opening through a vaporization chamber to a vapor outlet opening; a mouthpiece connectable to a main body of the electronic cigarette, the mouthpiece comprising a vapor channel for receiving vapor from the main vapor channel of the cartridge; and wherein the cartridge is axially displaceable by a consumer with respect to the mouthpiece in the axial direction thereof and movable between a first position and second position, and wherein in the first position both the air inlet opening and the vapor outlet opening of the cartridge is open, and in the second position both the air inlet opening and the vapor outlet opening of the cartridge is closed.

Thus, the main vapor channel of the cartridge can be selectively opened and closed at opening by the consumer by axially displacing the cartridge with respect to the mouthpiece or preferably with respect to the other parts of the electronic cigarette. Thereby, the main vapor channel is opened and closed both at the air inlet opening and at the vapor outlet opening. This prevents any leaking and drying out of the liquid through the openings of the liquid store. The axial displacement of the cartridge further allows a simple construction thereof. Particularly, it allows to arrange the vapor outlet opening at a top and to arrange the air inlet opening at the bottom of the cartridge. Further, it allows providing a main vapor channel that is generally axially arranged through the cartridge.

Further, the cartridge is axially displaceable by the consumer with respect to a main body of the electronic cigarette to selectively open and close the main vapor channel. Thus, the cartridge can be displaced with respect to the main body of the electronic cigarette for opening and closing the main vapor channel preferably at both ends.

Preferably, the mouthpiece is stationary and attached to a main body of the electronic cigarette. When the cartridge is axially displaceable the mouthpiece can be stationary with respect to the main body of the electronic cigarette. This improves the stability of the overall electronic cigarette.

Preferably, the mouthpiece portion further comprises a first sealing element to which the vapor outlet opening of the cartridge abuts in its closed position. For closing the vapor outlet opening of the cartridge the cartridge is axially moved such that the vapor outlet opening abuts the first sealing element. Thereby the first sealing element closes the vapor outlet opening.

Preferably, the first sealing element is arranged at or within the mouthpiece. Thus, the first sealing element can be arranged in a space saving manner at or within the mouthpiece. This further allows a simple construction and saves additional parts.

Preferably, the air inlet opening of the cartridge comprises a second sealing element which selectively closes the air inlet opening. The air inlet opening of the liquid store can be selectively opened and closed by the second sealing element.

Preferably, the second sealing element is an elastic membrane. An elastic membrane provides a reliable and easy construction of a sealing element that can be actuated by axially shifting the liquid store.

In a further aspect of the invention an electronic cigarette has a main body and a mouthpiece portion as described above, wherein the main body comprises a cartridge seating configured to receive the cartridge. The cartridge is held in a specially designed cartridge seating that allows for an axial displacement of the cartridge.

Preferably, the cartridge seating comprises an opening pin which in the open position of the cartridge protrudes through the second sealing element. The opening pin opens and closes the second sealing element, when the cartridge is axially shifted.

Preferably, the opening pin is hollow and provides an air channel therethrough. Thus, the hollow opening pin provides the air entering into the main vapor channel.

Preferably, for setting the first position of the cartridge, the cartridge is moved in axial direction away from the mouthpiece and for setting the second position of the cartridge, the cartridge is moved in axial direction to the mouthpiece.

Preferably, the electronic cigarette is arranged such that the axial movement of the cartridge is actuated by the user. Thus, the user or consumer can simply open and close the main vapor channel of the cartridge by axially shifting the cartridge.

Preferably, the axial movement of the cartridge is conducted by a rotational movement of the cartridge with respect to the main body. The axial shifting of the cartridge can be initiated by a rotation of the cartridge.

Preferably, the cartridge and/or the main body comprise at least one inclined plane for transforming a rotational movement of the cartridge into the axial movement of the cartridge. The inclined plane can preferably be arranged at the underside of the cartridge and cooperate with a corresponding inclined plane at the cartridge seating. Preferably, the inclined plane has a geometry such that a rotation of less than 180° provides the sufficient axial displacement of the cartridge.

Preferably, the axial movement of the cartridge is less than 10 mm, preferably less than 5 mm, more preferred less than 3 mm and even more preferred less than 2 mm. Thus, only a small axial movement of the cartridge is required for opening and closing the main vapor channel.

Preferably, the electronic cigarette further comprises an electric switch that is actuated by the axial displacement of the cartridge. The electric switch preferably sets the electronic cigarette in an operation mode, only if the cartridge is in the first position. This prevents an undesired waste of energy loss.

Preferably, the electric switch comprises electric contacts arranged at the main body and electrical contacts arranged at the cartridge, wherein the cartridge electric contacts contact the main body electric contacts when the cartridge is displaced to its first position. Thus, the electric switch can further provide electric energy to a vaporizer arranged within the main vapor channel.

Preferably, the electric switch enables an activation of a vaporizer only in the first position of the cartridge.

In a further aspect of the invention a cartridge for an electronic cigarette, comprising a liquid store having housing configured to store a liquid to be vaporized, the cartridge comprising a main vapor channel extending therethrough, between an air inlet opening through a vaporization chamber to a vapor outlet opening; and an elastic membrane for selectively opening and closing the air inlet opening of the main vapor channel. Thus, a pierceable membrane is provided as valve for the air inlet opening of a cartridge. This allows an easy and reliable opening and closing of the air inlet opening by an axial displacement of the cartridge. A closing of the air inlet opening prevents evaporation or spilling of liquid out of this opening.

Preferably, the elastic membrane is configured to be opened by an opening pin, that can protrude through the elastic membrane. Thus, an easy mechanism for opening the air inlet opening is provided.

Preferably, the elastic membrane is configured to automatically re-close after protrusion. Thus, the air inlet opening can be opened and closed a plurality of times.

Preferably, the cartridge is configured to be axially displaceable within a main body of an electronic cigarette between a first position and a second position of the cartridge, wherein in the first position both the air inlet opening and the vapor outlet opening of the cartridge is open, and in the second position both the air inlet opening and the vapor outlet opening of the cartridge is closed.

In a method of using an electronic cigarette, the electronic cigarette has a main body, and a mouthpiece portion comprising a cartridge comprising a liquid store having a housing configured to store a liquid to be vaporized, the cartridge comprising a main vapor channel extending therethrough, between an air inlet opening through a vaporization chamber to a vapor outlet opening; a mouthpiece connectable to a main body of the electronic cigarette, the mouthpiece comprising a vapor channel for receiving vapor from the main vapor channel of the cartridge; wherein the method comprises the steps of:

a. axially displacing the cartridge with respect to the mouthpiece in a first axial direction for moving the cartridge to a first position, in which both the air inlet opening and the vapor outlet opening of the cartridge are open, and
b. axially displacing the cartridge with respect to the mouthpiece in second axial direction thereof for moving the cartridge to a second position in which both the air inlet opening and the vapor outlet opening of the cartridge are closed.

Preferably the steps of axially displacing the cartridge comprises the step of further rotating the cartridge with respect to the main body, respectively. Thus, the axial displacement of the cartridge can be done by a rotation of the cartridge. This rotation is preferably by an amount of less than 180°.

BRIEF DISCUSSION OF THE FIGURES

Figure 1B:
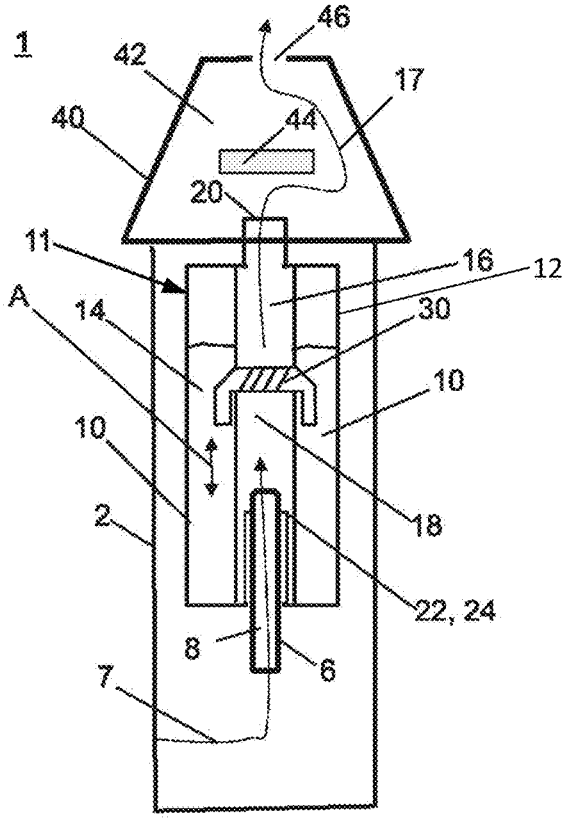
Figure 2:
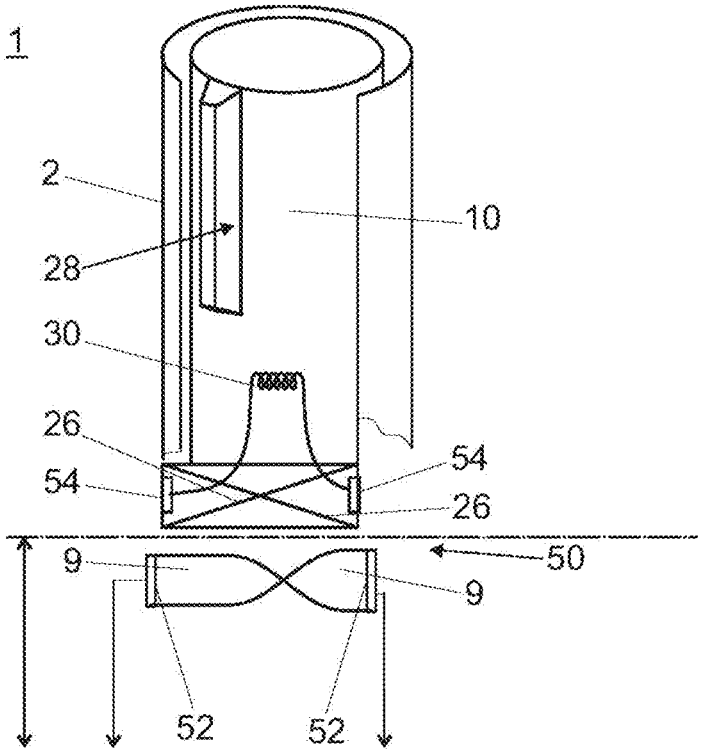
Figure 3A:
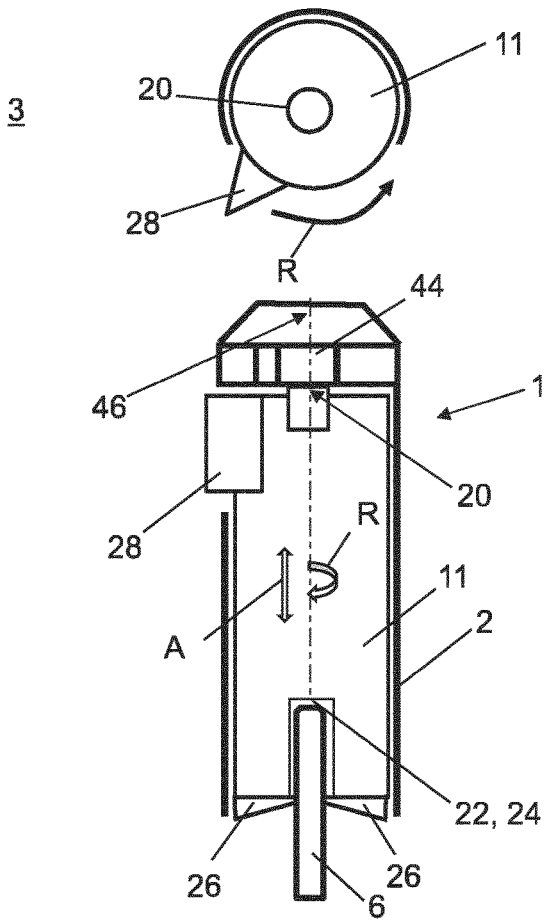
Figure 3B:
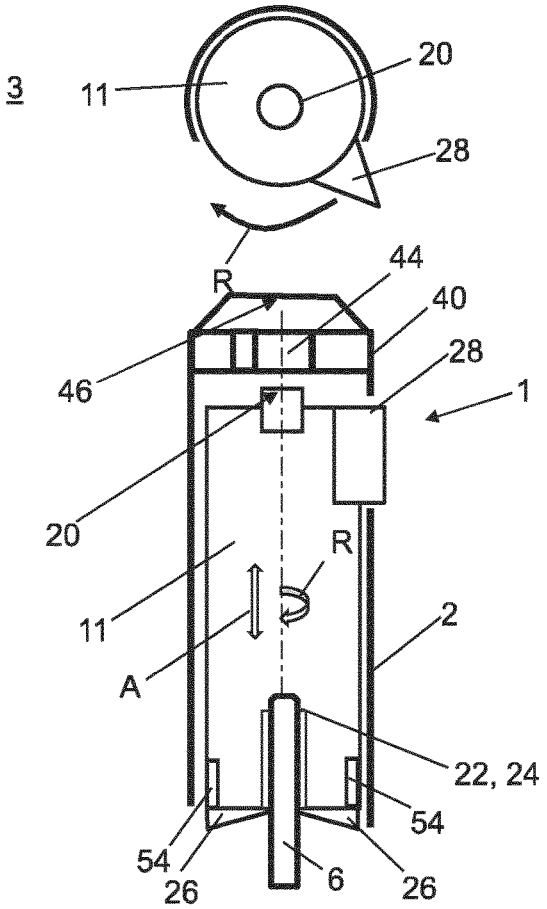
Figure 4:
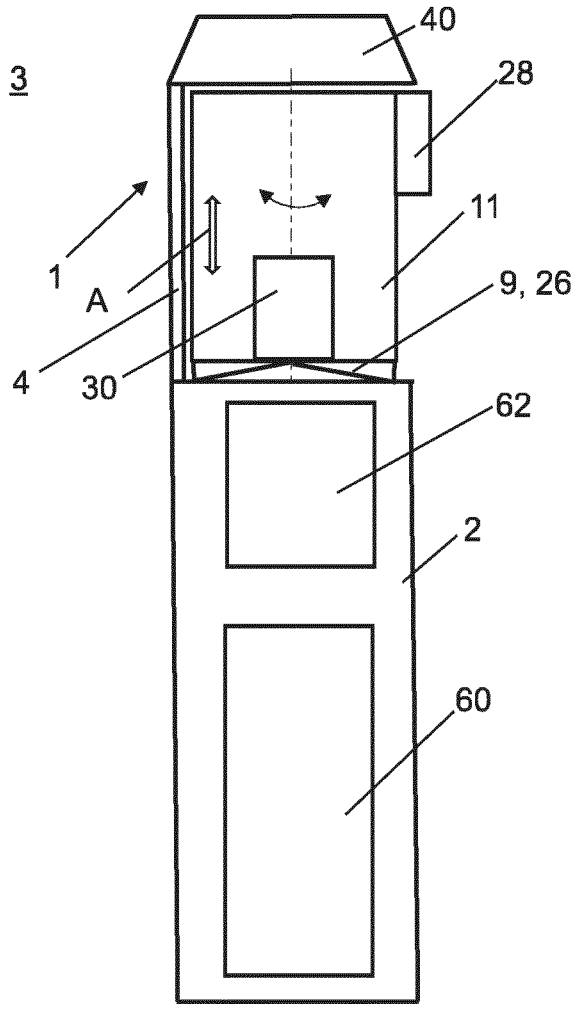

The invention will now be described with reference to the appended drawings, which by way of example illustrate embodiments of the present invention and in which like features are denoted with the same reference numerals, and wherein:

FIG. 1A: shows a schematic sectional view of an embodiment of a mouthpiece portion in a closes position where the cartridge is upwardly displaced;

FIG. 1B: shows a schematic sectional view of the embodiment of a mouthpiece portion of FIG. 1A in a closed position where the cartridge is downwardly displaced;

FIG. 2: shows a schematic three-dimensional view of a further embodiment of a mouthpiece portion, where the axial displacement of the cartridge is generated by a rotation of the cartridge;

FIG. 3A: shows a schematic sectional view of an upper part of an electronic cigarette with a preferred embodiment of mouthpiece portion with a rotatable and axially displaceable cartridge, where the cartridge is upwardly displaced;

FIG. 3B: shows a schematic sectional view of the embodiment of an upper part of an electronic cigarette of FIG. 3A, where the cartridge is downwardly displaced; and FIG. 4: shows schematically the main components of an electronic cigarette, wherein the mouthpiece portion comprises a rotatable and axially displaceable cartridge.

DETAILED DESCRIPTION

In the following preferred embodiments of the invention are described with respect to the figures. Although certain features are described with respect to specific embodiments, they may be used in other embodiments as well as appropriate.

As used herein and shown in FIG. 4, an "electronic cigarette" 3 may include an electronic cigarette 3 configured to deliver an aerosol to a user, including an aerosol for smoking. An aerosol for smoking may refer to an aerosol with particle sizes of 0.5-7 microns. The particle size may be less than 10 or 7 microns. The electronic cigarette 3 may be portable and can be used as a substitute for a conventional cigarette. The electronic cigarette 3 has generally a main body 2 comprising a power supply unit, like a battery 60, and an electrical control circuitry 62 for supplying a vaporizer 30 with electric energy.

Referring to the drawings, and initially to FIGS. 1A and 1B a first embodiment of a mouthpiece portion 1 for an electronic cigarette for vaporizing a liquid 14 is illustrated. The electronic cigarette 3 further has a cartridge seating 4. The cartridge seating 4 is configured to receive a removable cartridge 11 containing a liquid 14 to be vaporized. The cartridge 11 comprises a liquid store 10 having a housing 12 for storing liquid 14 to be vaporized and the electric vaporizer 30

The mouthpiece 40 can be fixedly and stationary attached to the main body 2 of the electronic cigarette 3. The mouthpiece 40 may therefore comprise a fastener to enable a mechanical connection to the cartridge seating 4, e.g., as shown in FIG. 4, of the main body 2 of the electronic cigarette 3. Hence, in use of the electronic cigarette 3 the fastener enables the mouthpiece 40 to remain stationary in the main body 2 of the electronic cigarette 3. The fastener can be in the form of a threaded connection. Alternatively, a friction fit, a snap fit or a magnetic fastener or fastening arrangement can be used.

The mouthpiece 40 may have a tip-shaped form to correspond to the ergonomics of the user's mouth and has a vapor outlet 46 for delivering vapor to the user.

The vaporizer 30 is fluidically connected to the cartridge 11 for obtaining the liquid 14 to be vaporized. The vaporizer 30 comprises a heating element 31 and a fluid transfer element 33 which is configured to transfer the liquid 14 by capillary action from the housing 12 to the heating element 31. The fluid transfer element 33 can be a fibrous or porous element such as a wick made from twined cotton or silica. Alternatively, the fluid transfer element 33 can be any other suitable porous element, such as porous ceramic. In the embodiment of FIGS. 1 and 1 the vaporizer 30 is integral with the cartridge 11 and arranged within a vaporization chamber 18 thereof. In other embodiments the vaporizer 30 can be separate from the cartridge 11 and can comprise a separate vaporizer housing. In such an embodiment (not shown) the vaporizer housing can be mounted on a vaporizer seating of the main body 2. The vaporizer seating can also provide an electrical connection between the vaporizer 30 and the main body 2 that supplies the vaporizer 30 with electric energy. Such a separate vaporizer 30 can be replaced independently from the cartridge 11.

The liquid 14 may comprise an aerosol-forming substance such as propylene glycol or glycerol and may contain other substances such as nicotine. The liquid 14 may also comprise flavorings such as e.g. tobacco, menthol or fruit flavor. The liquid 14 is contained in the liquid store 10 of the cartridge 11.

The housing 12 of the liquid store 10 may be made of a transparent material, such that the liquid level within the liquid store 10 is clearly visible to the user. The housing 12 may be formed in a polymeric or plastic material, such as polyester.

The cartridge 11 has a main vapor channel 16 with an air inlet opening 22 for receiving air and a vapor outlet opening 20 for supplying vapor 17 of the liquid 14 to the mouthpiece 40. The main vapor channel 16 is preferably arranged centrally within the essentially cylindrically shaped cartridge 11 and extends essentially in axial direction A.

The mouthpiece 40 comprises a vapor channel 42 inside the mouthpiece 40 for receiving vapor directly from the vapor outlet opening 20 of the main vapor channel 16 of the cartridge 11. The mouthpiece 40 further comprises a vapor outlet 46 for providing the received vapor 17 to the user, as shown in FIG. 1B.

Cartridge 11 is axially displaceable with respect to the mouthpiece 40 in axial direction A thereof. By the displacing cartridge 11 in the axial direction A, cartridge 11 can be brought by the user into a second or closed position, shown in FIG. 1A and into a first or open position for consuming vapor 17, as shown in FIG. 1B.

In the second or closed position of the cartridge 11, the air inlet opening 22 at the lower end of the cartridge 11 is closed by a second sealing element 24. The second sealing element 24 is preferably an elastic membrane. The elastic membrane 24 can preferably be a thin self-closing elastic element made of an elastomer material. In the second position of the cartridge 11 the vapor outlet opening 20 of the main vapor channel 16 is closed by a first sealing element 44. The first sealing element 44 is preferably stationary arranged within the mouthpiece 40 and is made of an elastomer material. In the second position of the cartridge 11 the vapor outlet opening 20 abuts the first sealing element 44 such that the vapor outlet opening 20 is closed. Since both, the air inlet opening 22 and the vapor outlet opening 20 of the main vapor channel 16 is closed, a leaking or evaporating of liquid 14 through the main vapor channel 16 is avoided.

If the cartridge 11 is axially displaced to the first or open position in axial direction A, the vapor outlet opening 20 is moved away from the first sealing element 44, what opens the vapor outlet opening 20 of the main vapor channel 16. This allows that vapor 17 is flowing from the main vapor channel 16 into the vapor channel 42 of the mouthpiece 40.

In the first or open position of the cartridge 11, the air inlet opening 22 is also opened by an opening pin 6 that protrudes through the membrane of the second sealing element 24. The opening pin 6 preferably has a hollow tubular shape and is stationary arranged in a cartridge seating 4 in the main body 2 of the electronic cigarette 3. By the hollow tubular shape, it provides an air channel 8 inside the opening pin 6 for providing air 7 to the lower area of the main vapor channel 16. For doing so the opening pin 6 has an air connection to the ambient for receiving air.

Alternatively, the opening pin 6 may be non-hollow but provide a shape for opening the membrane of the second sealing element 24 and simultaneously allowing air flowing through the opened membrane. Thus, the opening pin 6 may have a c-shaped, +-shaped or star-shaped cross-section. As shown in FIG. 1A the upper end of the opening pin 6 is arranged at a distance from the membrane, wherein is smaller than the axial displacement in the axial direction A for allowing a protrusion of the elastic membrane 24 by the opening pin 6. The elastic membrane 24 is preferably shaped and elastic such that it closes every time if the opening pin 6 is pulled out of it.

FIGS. 2, 3A and 3B show schematically a further embodiment of a mouthpiece portion 1. FIG. 3A shows the upper end of an electronic cigarette 3, where the cartridge 11 is displaced to the second or closed position. FIG. 3B shows the same electronic cigarette 3, where the cartridge 11 is displaced to the first or open position. The upper illustrations in FIGS. 3A and 3B show a top view on the cartridge 11. In this embodiment the cartridge 11 comprises an axial displacement mechanism, configured to move the cartridge 11 in the axial (longitudinal) direction A of the electronic cigarette 3 by rotation R. In an embodiment, the axial displacement mechanism comprises inclined planes 26 at the bottom end of the cartridge 11 which cooperate with corresponding inclined planes 9 of the cartridge seating 4. The inclined planes 9, 26 cooperate to transform a rotational movement of the cartridge 11 into an axial movement in the axial direction A thereof. Thus, the user can rotate the cartridge 11 for displacing it in axial direction A and for opening and closing the main vapor channel 16. As shown in FIG. 2 the rotational movement may be around an angle of less than 180°, preferably less than 120° and preferably less than 90°. The mouthpiece portion 1 may further comprise one or more springs that may urge the cartridge 11 to either the first or the second position.

For facilitating a rotation of the cartridge 11 it may comprise a handling feature 28 arranged at the outer side of the cartridge 11. The handling feature 28 may be in the shape of an axially oriented ridge 28, as shown in FIG. 2. Such handling feature 28 further helps the user in positioning the cartridge 11 within the main body 2 when the cartridge 11 is replaced.

As shown in FIG. 3B the cartridge 11 at the lower end thereof further comprises power supply contacts 54 that provide electric energy to the electric heating element 31 of the vaporizer 30 within a vaporization chamber 18 (not shown in FIGS. 2, 3A and 3B) inside the cartridge 11. Preferably, the power supply contacts 54 cooperate with corresponding electric contacts 52 of the main body 2 (see FIG. 2), such that they act as an electric switch 50 that can conduct electrical energy from the power supply unit of the electronic cigarette to the vaporizer 30 only, when the cartridge 11 is axially displaced to the first position as shown in FIG. 3B.

LIST OF REFERENCE SIGNS

1 mouthpiece portion
2 main body of electronic cigarette
3 electronic cigarette
4 cartridge seating
6 opening pin
7 air
8 air channel
9 inclined plane
10 liquid store
11 cartridge
12 liquid store housing
14 liquid
16 main vapor channel
17 vapor
18 vaporization chamber
20 vapor outlet opening
22 air inlet opening
24 second sealing element
26 inclined plane
28 handling feature
30 vaporizer
31 heating element
33 fluid transfer element
40 mouthpiece
42 vapor channel
44 first sealing element
46 vapor outlet
50 electric switch
52 electric contacts at main body
54 electric contacts at cartridge
60 battery
62 electronic circuitry

The invention claimed is:

1. A mouthpiece portion of an electronic cigarette, the mouthpiece portion comprising:
- a cartridge comprising:
  - a liquid store having a housing configured to store a liquid to be vaporized, and
  - a main vapor channel extending through the liquid store and between an air inlet opening through a vaporization chamber to a vapor outlet opening; and
- a mouthpiece connectable to a main body of the electronic cigarette, the mouthpiece comprising a vapor channel for receiving vapor from the main vapor channel of the cartridge,
- wherein the cartridge is configured to be at least partially positioned within the main body of the electronic cigarette,
- wherein the cartridge is axially displaceable by a consumer with respect to the mouthpiece in an axial direction thereof and movable between a first position and a second position, and wherein in the first position both the air inlet opening and the vapor outlet opening of the cartridge are open, and in the second position both the air inlet opening and the vapor outlet opening of the cartridge are closed, and
- wherein the cartridge is axially displaceable by the consumer with respect to the main body of the electronic cigarette to selectively open and close the main vapor channel.

2. The mouthpiece portion according to claim 1, wherein the mouthpiece is stationary and attached to the main body of the electronic cigarette.

3. The mouthpiece portion according to claim 1, further comprising a first sealing element to which the vapor outlet opening of the cartridge abuts when the cartridge is in the second position.

4. The mouthpiece portion according to claim 3, wherein the air inlet opening of the cartridge comprises a second sealing element which selectively closes the air inlet opening.

5. The mouthpiece portion according to claim 4, wherein the second sealing element is an elastic membrane.

6. The mouthpiece portion according to claim 3, wherein the first sealing element is arranged at or within the mouthpiece.

7. An electronic cigarette having the mouthpiece portion according to claim 1 and a main body, wherein the main body comprises a cartridge seating configured to receive the cartridge.

8. The electronic cigarette according to claim 7, wherein the air inlet opening of the cartridge comprises a second sealing element which selectively closes the air inlet opening, and further comprising an opening pin which, when the cartridge is in the first position, protrudes through the second sealing element.

9. The electronic cigarette according to claim 8, wherein the opening pin is hollow and provides an air channel therethrough.

10. The electronic cigarette according to claim 7, wherein, for setting the first position of the cartridge, the cartridge is moved in the axial direction away from the mouthpiece and for setting the second position of the cartridge, the cartridge is moved in the axial direction toward the mouthpiece.

11. The electronic cigarette according to claim 7, wherein the electronic cigarette is arranged such that axial movement of the cartridge is actuated by the consumer.

12. The electronic cigarette according to claim 7, wherein axial movement of the cartridge is conducted by a rotational movement of the cartridge with respect to the main body.

13. The electronic cigarette according to claim 12, wherein the cartridge and/or the main body comprise at least one inclined plane for transforming a rotational movement of the cartridge into the axial movement of the cartridge.

14. The electronic cigarette according to claim 7, wherein axial movement of the cartridge is less than 10 mm.

15. The electronic cigarette according to claim 14, wherein the axial movement of the cartridge is less than approximately 5 mm.

16. The electronic cigarette according to claim 14, wherein the axial movement of the cartridge is less than approximately 3 mm.

17. The electronic cigarette according to claim 14, wherein the axial movement of the cartridge is less than approximately 2 mm.

18. The electronic cigarette according to claim 7, further comprising an electric switch that is actuated by axial displacement of the cartridge.

19. The electronic cigarette according to claim 18, wherein the electric switch comprises electric contacts arranged at the main body and electrical contacts arranged at the liquid cartridge, wherein the liquid cartridge electric contacts contact the main body electric contacts when the cartridge is displaced to the first position.

* * * * *